United States Patent [19]

Durand

[11] Patent Number: 4,751,358

[45] Date of Patent: Jun. 14, 1988

[54] COOKING CONTAINER HAVING A BROWNING COATING FOR MICROWAVE OVENS AND A METHOD OF FORMING THE COATING

[75] Inventor: Philippe Durand, Arques, France

[73] Assignee: Verrerie Cristallerie d'Arques J.G. Durand & Cie, Arques, France

[21] Appl. No.: 47,335

[22] Filed: May 7, 1987

[30] Foreign Application Priority Data

May 21, 1986 [FR] France ..... 86 07183
Apr. 6, 1987 [FR] France ..... 87 04801

[51] Int. Cl.[4] ..... H05B 6/64

[52] U.S. Cl. ..... 219/10.55 E; 219/10.55 F; 426/107; 426/243; 126/390; 99/DIG. 14

[58] Field of Search ..... 219/10.55 E, 10.55 F, 219/10.55 M, 10.55 R; 99/451, DIG. 14; 426/107, 243, 241; 126/390

[56] References Cited

U.S. PATENT DOCUMENTS 4,190,757 2/1980 Turpin et al. ..... 219/10.55 E
4,203,357 5/1980 Vaussanvin ..... 219/389 X
4,266,108 5/1981 Anderson et al. ..... 219/10.55 M
4,410,779 10/1983 Weiss ..... 219/10.55 F
4,653,461 3/1987 Eke ..... 219/10.55 E X

*Primary Examiner*—Philip H. Leung
*Attorney, Agent, or Firm*—Gottlieb, Rackman & Reisman

[57] ABSTRACT

A cooking receptacle is provided having a browning coating for microwave ovens, and a method of forming such a coating. Said coating, which is external, includes essentially a heating layer made from leadless enamel in which are incorporated electrically conducting elements in the form of a metal powder, this powder being intimately mixed with the enamel, generally in a proportion of 15 to 40% by weight; a protective layer of leadless enamel advantageously covers the heating layer. The layers are deposited on the external surface of the receptacle by silkscreen printing or by decalcomania or by a transfer method and they are subjected to baking at a temperature between 620° and 800° C. The metal powder is formed from at least one substance chosen from the electrically conducting metals such as zinc and the transition elements, the oxides of these metals, and mixtures of these substances.

26 Claims, No Drawings

COOKING CONTAINER HAVING A BROWNING COATING FOR MICROWAVE OVENS AND A METHOD OF FORMING THE COATING

BACKGROUND OF THE INVENTION

Browning containers for microwave ovens at present available on the market include, as browning coating, a conducting film of tin oxide. They have a fairly limited lifespan. Depending on the use, the heating time is longer and longer. This deterioration of the heating characteristics is in relationship with the low resistance to detergents of the electrically conducting tin film. This tin oxide film is normally applied by a process including heating the support with a solution of a thermally decomosable tin compound. In addition, this tin oxide film is not flame resistant, which limits the use of this dish exclusively to microwave ovens.

DESCRIPTION OF THE INVENTION

The invention provides a cooking receptacle (disk, saucepan etc) having a browning coating for microwave ovens, as well as a method of forming the coating, eliminating the above mentioned drawbacks. In a very known per se, the browning coating, which allows the food to be browned in a microwave oven, is applied to the outside surface of the receptacle.

The electrically conducting metal elements are no longer provided by a thermally decomposable compound, they are incorporated in an enamel which may be applied in different ways on a non heated substrate, (which widens the possibilities in choosing the electrically conducting element and enormously facilitates the implementation of the method).

To improve the chemical resistance and particularly resistance to detergents, a protective enamel layer may be applied by superimposition on the electrically conducting enamel layer.

The browning coating of the cooking receptacle of the present invention, which coating is outside, includes essentially a heating layer, made from enamel without lead in which are incorporated electrically conducting elements in the form of a metal powder composed of at least one substance chosen from the electrically conducting metals and mixtures thereof, the oxides of these metals and mixtures thereof, and mixtures of these metals and their oxides, said powder being intimately mixed with the enamel. As metals may be mentioned zinc, aluminum, copper, nickel, chromium, transition elements, particularly iridium, platinum, ruthenium, rhodium, palladium, silver, gold, and the mixtures of these metals. The oxides which may be used are, in particular, those of the above mentioned metals and mixtures thereof and metal and oxide mixtures may also be used. Zinc, the transition metals, the corresponding oxides and mixtures of these substances are preferred; they provide particularly strong and durable coatings, resisting detergents and acids well.

The proportion of metal powder in said heating layer is generally from 15 to 40% by weight.

Said heating layer is advantageously coated with a protective enamel layer without lead. The thickness of the layers is about 12 to 30 μm for the first and 10 to 20 μm for the second. The leadless enamel of the heating layer or of the protective layer may have an acrylic resin basis including different mineral substances such as oxides, anhydrdes, salts.

The method of the inventio for forming a browning coating on cooking receptacles for microwave ovens is characterized in that on the outside surface of the receptacle is deposited a layer of a leadless enamel including in an intimate mixture a metal powder formed from at least one substance chosen from the electrically conducting metals and mixtures thereof, the oxides of these metals and mixtures thereof and mixtures of these metals and their oxides, the layer thus formed being subjected to baking at a temperature between 620° and 800° C. so as to provide a heating layer, in which the proportion of metal powder is generally from 15 to 40% by weight. Substances which may more particularly be used have been mentioned above. On the layer obtained before the baking operation, a protective layer of leadless enamel is advantageously deposited, after which the assembly of the two layers, whose thicknesses are those mentioned above, is subjected to said baking.

The leadless enamel used for the two layers may be such as defined above. This enamle is called leadless because its lead content (toxic metal) is very much less than the maximum content allowed by the standards existing in different countries for household or cooking utensils, the ananlysis being made from acetic acid at 4% by weight, in which the receptacle has been steeped for 24 hours at ambient temperature.

The deposition of each of the two layers may be carried out by hot silkscreen printing, employing a leadless enamel havinga thermofusible binder melting at about 40°-60° C., which enamel is applied thorugh a conducting silkscreen printing cloth heated to a temperature of about 60°-80° C.

Each of these two layers may also be deposited by decalcomania, at ambient temperature, in which case a leadless enamel is used having an oily binder.

The deposition may also be obtained by a transfer method: the layer of enamel is deposited, hot or cold depending on the nature of the enamel, by means of a block or a screen, on a plate or a membrane, then it is taken up with a silicon based pad for transfer to the outside surface of the receptacle to be coated.

The following examples illustrate the method. Enamels are used with a low expansion coefficient (38 and 58.10→).

EXAMPLE 1

Silkscreen Printing Method .

The leadless enamel, initially in the solid state, used for the heating layer includes, at the rate of 25 to 30% by weight, a thermofusible or thermoplastic binder which s a mixture of acrylic resins and a plastifier for these resins and, at the rate of 15 to 40% by weight, electrically conducting metal powder, for example formed of zinc or zinc oxides, or at least one transition metal or oxide of such a metal, or a mixture of these substances, the remainder being formed by different mineral substances (including the following constitutents: $SiO_2$, $B_2O_3$, $Al_2O_3$, ZnO, $Li_2O$, $ZrO_2$, BaO, $F_2$, $SnO_2$, $TiO_2$).

The thermofusible binder melts at a temperature of 40° to 60° C. Then the heating layer is deposted by silkscreen printing, by heating the conducting silkscreen printing cloth, on which the enamel is spread, at a temperature of 60° to 80° C., by direct (by Joule effect) or indirect (for example using infrared rays) heating. A heat application time of 30 seconds is sufficient for forming the coating on the outside surface of the receptacle, placed under the silkscreen printing cloth.

The protective layer is formed in the same way, with a leadless enamel of the same composition, except that it contains no electrically conducting metal powder; it is therefore richer in different mineral substances.

The baking of the coating including the two layers is carried out in an annealing furnace (of the annealing crown type) at a temperature between 620° and 800° C. The total time of the baking cycle is from 50 to 60 minutes.

The first layer has a thickenss of about 15 to 25 μm and the second a thickness of about 10 to 15 μm, the optimum thickness of the assembly of the two layers being 25 to 30 μm.

EXAMPLE 2

Decalcomania Method

The leadless enamels used for each of the two layers are initially oily. Their oily binder, which represents 15 to 20% of their weight, is a mixture of acrylic resins and terpenic oils. The other constituents are qualitatively identical with those of the two enamels described in example 1. The proportion of electrically conducting powder in the enamel used for the heating layer is, as for example 1, from 15 to 40% by weight.

The heating layer is deposited, then the protective layer, by decalcomania at ambient temperature. The thickness of the layers is about 20 μm for the first and about 10 μm for the second, the optimum thickness of the assembly of the two layers being from 25 to 30 μm.

Baking of the assembly of the two layers takes place as for example 1.

Advantages of the Final Heating and Browning Coating

The characteristics of this coating are the following:

1. Homogeneity of the temperature after a certain time of exposure to the (microwave) radiation.

For example, an empty dish of a thickness of 6 mm coated using the method as described in example 1 or 2 reaches a temperature of 300° C. after 5 minutes exposure in a microwave oven, instead of 80° to 100° C. without the coating.

The electrically conducting metal contained in the coating provides a sufficient temperature rise of the dish to obtain browning of the food which will be placed in the dish. It can further be observed that no electric arc occurs, that there are therefore no excessive hot points which could destroy the coating; it is assumed that this stabilization of the temperature rise is due to the presence in the coating of metal oxides, whether they are introduced at the outset in the heating layer or whether they are formed from the metal or metals initially used, during the final baking oepration of the coating.

2. Very good flame resistance; no impairment when subjected to flame for 24 hours on a gas cooker burner. The absence of lead in the enamel avoids blackening in the flame.

3. Very good chemical resistance; very good resistance to detergents in a dishwasher, after more than 300 washing operations.

The lifespan of the coating is practically unlimited. The enamels, which are the basis of its composition, ensure the fire resistance and resistance to chemical products and the fact that the coating has two layers reinforces this resistance.

Modifications of detail within technical equivalents may be made to the cooking receptacle and to the method described above, without departing from the scope or spirit of the invention.

What is claimed is:

1. A browning coating along the outside surface of a cooking receptacle for microwave ovens, said browning coating comprising a heating layer, said heating layer including:

a leadless enamel;

electrically conducting elements mixed with said enamel said elements comprising a metal powder selected from the group inclduing electrically conducting metals and mixtures thereof, oxides of said conducting metals and mixtures thereof and mixtures of said metals and said oxides;

wherein said heating layer has a thickness between about 12 μm and 30 μm.

2. The browning coating of claim 1, wherein said metal powder includes at least one substance selected form the group including zinc, aluminum, copper, nickel, chromium, a transition element and oxides of zinc, aluminum, copper, nickel, chromium and said transition element.

3. The browning coating of claim 2, wherein said transition element is selected from the group including iridum, platinum, ruthenium, rhodium, palladium, silver, gold, and mixtures thereof.

4. The browning coating of claim 1, wherein said metal powder includes at least one substance selected from the group including zinc, zinc oxides and mixtures of zinc and zinc oxides.

5. The browning coating of claim 1, wherein said metal powder includes at least one substance selected from the group including iridium, platinum, ruthenium, rhodium, palladium, silver, gold, mixtures of said substances, oxides of said substances, mixtures of said oxides and mixtures of said substances and said oxides.

6. The browning coating of claim 1, wherein said metal powder is present in said heating layer in an amount between about 15 and 40 weight percent.

7. The browning coating of claim 1, further including a protective layer of leadless enamel coated over said heating layer.

8. The browning layer of claim 7, wherein said protective layer has a thickness between about 10 μm and 20 μm.

9. The browning coating of claim 7, wherein said leadless enamel includes a mixture of acrylic resins.

10. The browning coating of claim 9, wherein said heating layer further includes a component comprising mineral substances.

11. The browning coating of claim 10, wherein said mineral substances are selected from oxides, anydrides, and salts.

12. The browning coating of claim 11, wherein said mineral substances are selected form the group including $SiO_2$, $B_2O_3$, $Al_2O_3$, ZnO, $Li_2O$, $ZrO_2$, BaO, $F_2$, $SnO_2$ and $TiO_2$.

13. The browning coating of claim 9, wherein said leadless enamel is present in an amount between about 25 and 30 weight percent.

14. A method of forming a browning coating on the outside surface of a microwave cooking receptacle, said method comprising depositing a layer of leadless enamel that is mixed with electrically conducting elements along the outside surface of said receptacle; and baking said layer at a temperature between about 620° and 800° C. in order to form a heating layer on the outside surface of said receptacle having a thickness between about 12 μm and 30 μm.

15. The method of claim 14, wherein said electrically conducting elements comprise a metal powder in an amount between about 15 and 40 weight percent based on the total weight of the resulting heating layer.

16. The method of claim 15, wherein said protective layer is deposited at a thickness between about 10 and 20 μm.

17. The method of claim 14, further including the step of depositing a protective layer of leadless enamel over said mixed enamel layer prior to said baking step.

18. The method of claim 14, wherein said layer is deposited by hot silk screen printing.

19. The method of claim 18, wherein said leadless enamel includes a thermofusible binder melting at a temperature between about 40° and 60° C., and wherein said enamel is supplied through a conducting silkscreen printing cloth heated to a temperature between about 60° and 80° C.

20. The method of claim 14, wherein said layer is deposited by decalcomania at ambient temperature.

21. The method of claim 14, wherein said layer is deposited by means of a transfer method.

22. A heating layer coated along the outside surface of a microwave oven cooking receptacle, said heating layer comprising:

a leadless enamel; and electrically conducting elements mixed with said enamel;

wherein said heating layer has a thickness betwen about 12 μm and 30 μm.

23. The heating layer of claim 22, wherein said electrically conducting elements comprise a metal powder.

24. The heating layer of claim 23, wherein said metal powder is present in said heating layer in an amount between about 15 and 40 weight percent.

25. The heating layer of claim 22, wherein said heating layer is coated with a protective layer of leadless enamel.

26. A cooking receptacle suitable for repeated use in a microwave oven and repeated washing comprising:

a heating layer coated along the outside surface thereof, said heating layer including a leadless enamel and electrically conducting elements mixed with said enamel, said heating layer coated along the outside surface of said cooking receptacle by depositing a layer of said leadless enamel thereon and then baking said layer at a temperature between about 620° and 800° C.

* * * * *